US005988778A

United States Patent [19]

Lammens

[11] Patent Number: 5,988,778

[45] Date of Patent: Nov. 23, 1999

[54] ROD-BASED FILE INTERLOCK SYSTEM

[75] Inventor: Arthur E. Lammens, Fullerton, Calif.

[73] Assignee: Accuride International, Inc., Santa Fe Springs, Calif.

[21] Appl. No.: 08/951,935

[22] Filed: Oct. 16, 1997

Related U.S. Application Data

[63] Continuation of application No. 08/680,563, Jul. 12, 1996, abandoned.

[51] Int. Cl.[6] ..... E05B 65/46

[52] U.S. Cl. ..... 312/217; 312/221; 312/219

[58] Field of Search ..... 312/216, 217, 312/221, 219, 218

[56] References Cited

U.S. PATENT DOCUMENTS

| | | |
|---|---|---|
| 3,323,849 | 6/1967 | Stark . |
| 3,454,320 | 7/1969 | Olree . |
| 3,531,171 | 9/1970 | Raabe et al. . |
| 3,705,754 | 12/1972 | Drum et al. . |
| 3,874,755 | 4/1975 | Hegg et al. . |
| 3,881,793 | 5/1975 | Anderson . |
| 3,900,236 | 8/1975 | Goulish et al. . |
| 3,998,508 | 12/1976 | Scheerhorn . |
| 4,239,309 | 12/1980 | De Fouw et al. . |
| 4,240,685 | 12/1980 | Terlecki . |
| 4,272,138 | 6/1981 | Stark . |
| 4,298,236 | 11/1981 | Laroche . |
| 4,352,529 | 10/1982 | Steinke . |
| 4,355,851 | 10/1982 | Slusser . |
| 4,429,930 | 2/1984 | Blouin . |
| 4,478,466 | 10/1984 | Clark et al. . |
| 4,480,883 | 11/1984 | Young . |
| 4,637,667 | 1/1987 | Reid et al. . |
| 4,768,844 | 9/1988 | Ludwig . |
| 4,936,640 | 6/1990 | Pratzer . |
| 4,966,423 | 10/1990 | Higuera et al. . |
| 4,971,281 | 11/1990 | Steinbeck . |
| 5,056,877 | 10/1991 | Westwinkel . |
| 5,062,678 | 11/1991 | Westwinkel . |
| 5,069,263 | 12/1991 | Edwards . |
| 5,074,627 | 12/1991 | Broeders . |
| 5,102,210 | 4/1992 | Beals . |
| 5,251,974 | 10/1993 | Beals . |
| 5,352,030 | 10/1994 | Derle et al. . |
| 5,366,283 | 11/1994 | Crose . |
| 5,433,516 | 7/1995 | Beals et al. . |
| 5,634,701 | 6/1997 | Hendrich et al. . |

FOREIGN PATENT DOCUMENTS

| | | |
|---|---|---|
| 669439 | 8/1995 | European Pat. Off. . |
| 2173463 | 10/1973 | France . |
| 4327688 | 8/1993 | Germany . |
| 1471653 | 4/1977 | United Kingdom . |
| 2095322A | 9/1982 | United Kingdom . |
| 9406989 | 3/1994 | WIPO . |

*Primary Examiner*—Janet M. Wilkens
*Attorney, Agent, or Firm*—Christie, Parker & Hale, LLP

[57] ABSTRACT

An interlock assembly for use with two or more vertically arranged drawers mounted on telescopic slides in a housing such as a cabinet so as to prevent the extension of a drawer once another drawer is opened. The interlocking system interfaces with the stationary members of vertically arranged slides attached to the cabinet. A pair of opposing upper and lower actuator followers are slidably and transversely fitted near the front of the stationary members so that movement of one actuator follower toward the other, displaces the other. A rod connects the upper actuator follower of one slide with the lower actuator follower of a slide directly above it. An actuator is connected to the front ends of the telescopic members of the slides. As a telescopic member is extended, the actuator of that slide makes contact and displaces the upper actuator follower of the slide which results in the upper displacement of the lower actuator followers of the slides directly above the extended slide. The extended slide also prevents the upward displacement of the upper actuator followers of all the slides directly below it. Consequently, all actuator followers block the path of their respective telescopic members precluding their extension.

25 Claims, 9 Drawing Sheets

ROD-BASED FILE INTERLOCK SYSTEM

CROSS-REFERENCE TO RELATED APPLICATION

This is a continuation of application Ser. No. 08/680,563, filed Jul. 12, 1996, now abandoned.

BACKGROUND OF THE INVENTION

The present invention relates to an interlock assembly for use with multiple vertically arranged drawers or storage units mounted via a telescopic slide assembly in a unit such as a lateral drawer file cabinet. Specifically, the present invention relates to an interlock assembly which prevents the extension of any drawer once another drawer has been opened and which can interface with a locking system for locking all the drawers in a closed position.

Cabinets with multiple vertically arranged drawers may tilt over when more than one drawer is open at the same time, creating a hazard. The tilting of the cabinet is caused by the shifting of the cabinet center of gravity when two or more drawers are opened. Tilting of a cabinet is especially likely to occur when the open drawers contain relatively heavy materials.

To prevent such tilting, many cabinets with vertically arranged drawers incorporate interlock systems which prevent a drawer from being opened if another drawer is open. Some interlock systems in use today interface with the rear portion of the file drawers as is illustrated in U.S. Pat. No. 4,480,883. Their location makes their installation and repair difficult. Moreover, the position of such interlock mechanisms make it difficult to interface these systems with locking systems which are typically located at the front of the cabinet on either side of the top portion of the file housing.

Current interlock systems require that their components be installed or removed in a sequential order. For example, interlock components positioned between the lowermost slides must be installed prior to component located between the uppermost slides. An example of this design is an interlock mechanism utilizing a stack of latch bars as is shown in U.S. Pat. No. 4,637,667. Furthermore, components located proximate to the lowermost slides cannot be removed without first removing the components located proximate to the uppermost slides. This makes for a complex, time consuming, and costly interlock assembly installation and removal process.

In addition, most interlock assemblies in use today are designed for use with drawers of a specific height and cannot be easily altered for use with drawers of different heights.

Most interlock assemblies in use today also require that their components be built to precise tolerances. A shift in these tolerances may result in interlock assembly malfunction.

Rotational cam interlock systems are also currently in use such as are shown in PCT Application Serial No. PCT/CA93/00359 (International Publication No. WO94/07989) rely on instantaneous actuation upon drawer openings and may not always maintain a constant displacement while the drawer is open. They do not provide for a positive and maintained actuation so as to prevent system malfunction. This could result in inadvertent unlocking of the drawers. Accordingly, there is a need for an interlock assembly which can interface with the front of the slides used to couple the drawers to a cabinet or other housing and which can interface with the cabinet locking system. Moreover, an interlock assembly is needed that is easy to install, that does not require precise tolerances, and that can be easily altered for use with drawer arrangements comprising drawers of different heights.

SUMMARY OF THE INVENTION

The present invention provides a drawer slide interlock assembly for use with two or more vertically arranged drawers mounted on left and right sets of vertically spaced apart telescoping slides in a housing such as a file cabinet or storage unit. The interlock assembly may interface with either the left or right set of slides.

Each slide assembly comprises a stationary member which attaches to the cabinet and a telescoping member which attaches to the drawer.

A pair of opposing upper and lower actuator followers are slidably and perpendicularly located adjacent the front end of each stationary member. Each actuator follower may slide from a position blocking the extension path of the telescopic member to a position of not blocking such extension path. As one actuator follower moves toward the other, it abuts the other and displaces it. For example, as the lower actuator follower begins to move upward, it abuts against the upper actuator follower and as the upward movement continues so does the upward displacement of the upper actuator follower.

Rods are used to interconnect the upper actuator follower of one slide to the lower actuator follower of a immediately higher slide. The rods can easily snap in and, if necessary, snap out of the actuator followers. When connected into the actuator followers, the rods are free to move vertically within reasonable limits.

An actuator is fitted on the front end of the telescopic member. The actuator has tapered surfaces. Tapered surfaces on the actuator followers come in contact with the actuator tapered surfaces as the telescoping member is extended from its closed position or when it is retracted from an open position. The actuator and actuator followers are preferably made from a polymeric material so as to reduce friction, soften the impact between them and quiet the operation of the slide.

Upon extension of a telescoping member of one slide, the actuator in front of the telescoping member makes contact with the upper actuator follower of that slide and displaces it upwards. Consequently, the actuator follower displaces the rod and the interconnected lower actuator on the immediately higher slide, bringing the lower actuator follower in position to block the extension of the telescoping member of the slide. Simultaneously, this lower actuator follower displaces its opposing upper actuator follower. This process is simultaneously repeated and as a result, all lower actuator followers on the slides located above the extended slide move into position to block the extension of their respective telescopic members.

Similarly, the extended slide blocks the upward movement of the upper actuator followers of the lower slides. Consequently, all the upper actuator followers of the slides below the extended slide are precluded from moving upwards, thus, remaining in a position blocking the extension of their respective telescopic members.

A locking mechanism for locking all the slides in a closed position can easily be incorporated into this interlocking assembly. For example, a locking mechanism can be positioned such that it interferes with the upward movement of the uppermost actuator follower of the uppermost slide. This will preclude the upward displacement of any upper actuator follower of any slide. Consequently all of the upper actuator followers will be in a position blocking the extension of their respective telescopic members.

Similarly, a locking mechanism can also be incorporated anywhere along the height of the assembly. For example, a member can be used to bias any of the rods such that all the lower actuator followers on the slides directly above the biasing member are displaced upward, while all the upper actuator followers of the slides directly below the biasing member are prevented from being displaced upward. Consequently, an actuator follower on a slide of each drawer will be in a position to block the extension of its respective telescopic member.

DETAILED DESCRIPTION OF THE PREFERRED EMBODIMENTS

The present invention is an interlock assembly for use with two or more vertically arranged drawers mounted on telescopic slides in a housing such as a cabinet so as to prevent the extension of a drawer once another drawer has been opened.

Figure 1:
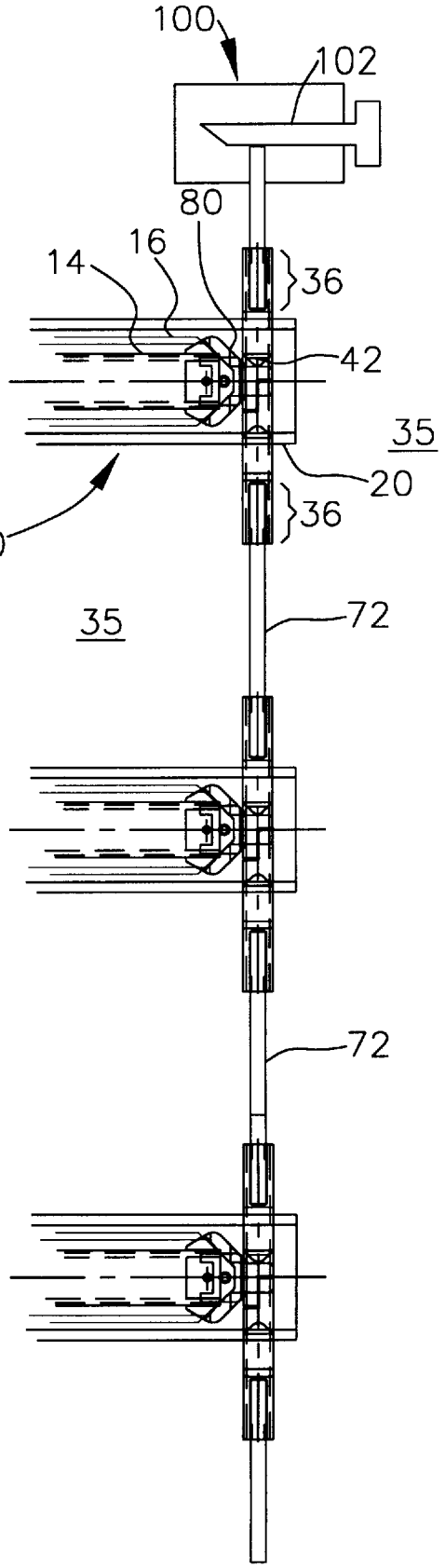
FIG. 1 is an interlock assembly interface with three vertically arranged slides with all the slides being in a fully closed position.
Figure 2:
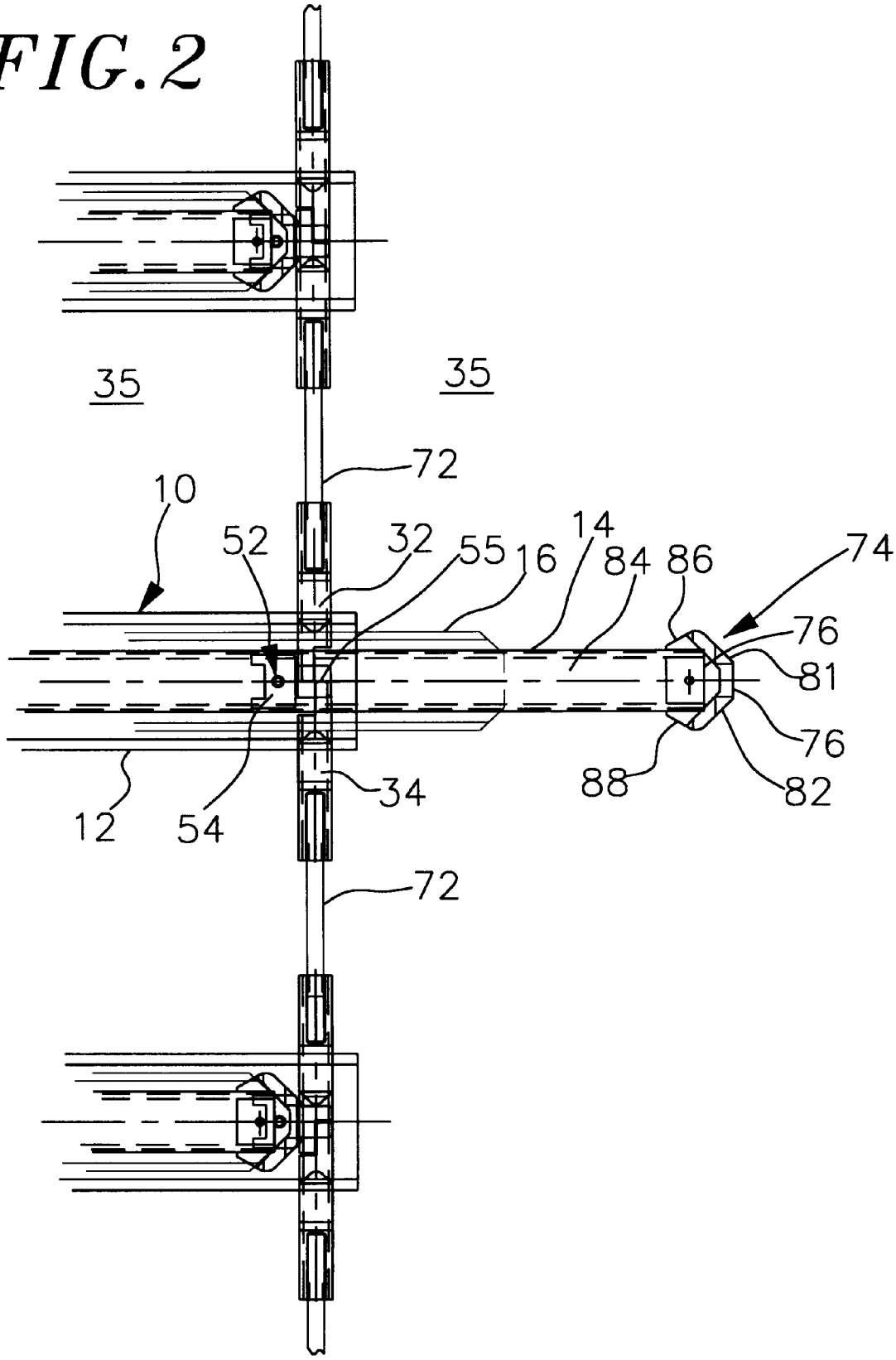
FIG. 2 depicts the interlock assembly interface with three vertically arranged slides with the center slide open.

The interlocking assembly interfaces with telescopic slides which are used to mount drawers into the cabinet (FIGS. 1, 2). The telescopic slides can be of various designs. For descriptive purposes, however, the present invention is described in terms of telescopic slides 10 having a channel shaped stationary member 12 which is attached to the cabinet wall 35 and a telescopic member 14 which is attached to the drawer (not shown). The telescopic member may preferably be coupled to the outer stationary member via an intermediate member 16. For descriptive purposes, the term "telescopic member" as used herein refers to the slidable member of the slide assembly. For slide assemblies which include an intermediate member, the term "telescopic member" refers to the slidable member of a two member slide and an intermediate slidable member of a three element slide.

Each drawer is slidably coupled to the cabinet using two slides. One slide is coupled to the left side of the drawer and the other to the right side of the drawer. Thus, a cabinet has a right and left set of slides. The interlocking assembly may interface with either the left or the right set of slides or both.

Figure 3A:
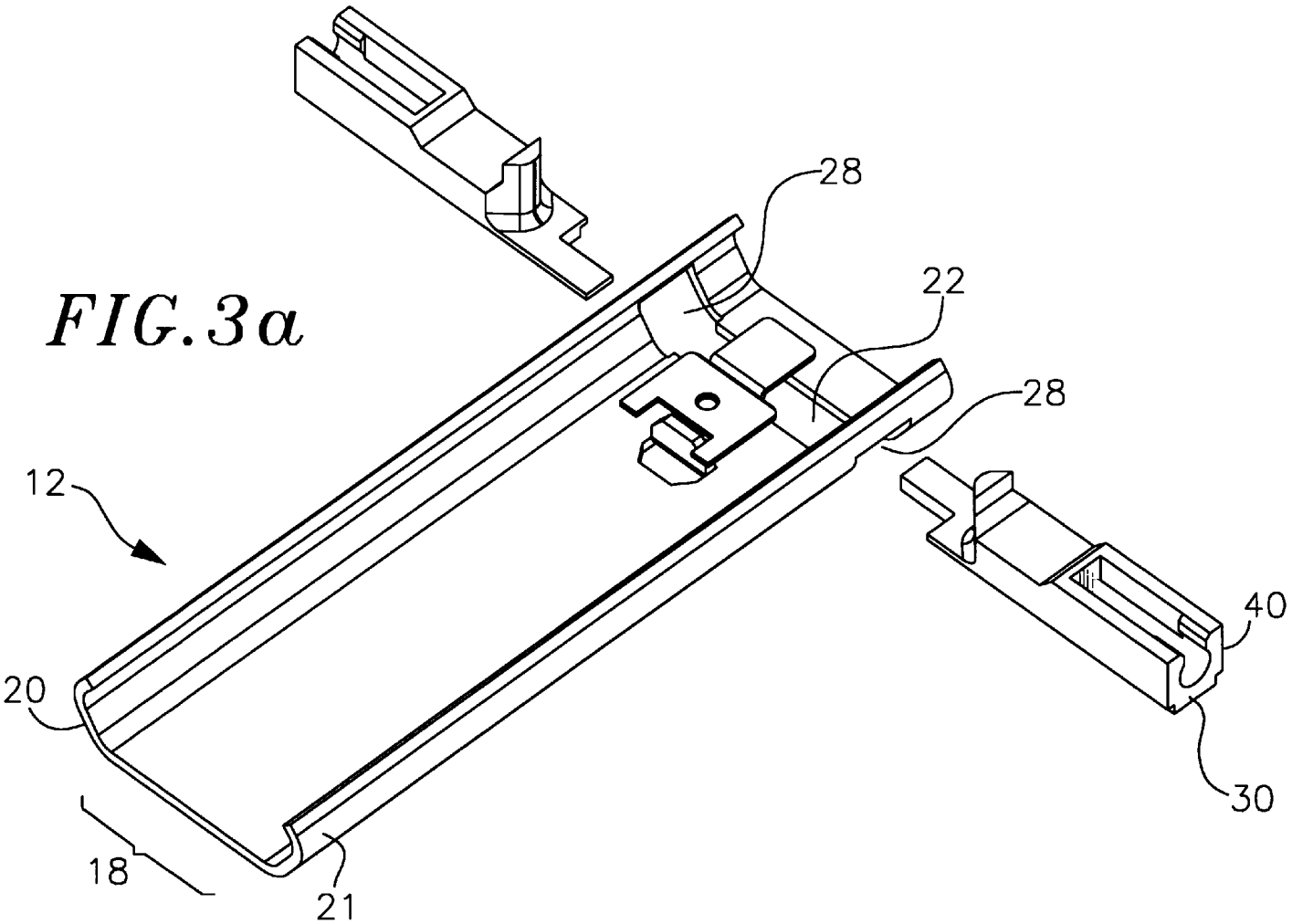
FIG. 3*a* is an isometric view of a slide stationary member showing the cutouts which allow for the slidable fitting of the actuator followers.

The stationary member 12 of each slide is channel shaped having a web section 18 from which extend lateral arcuate sections 20, 21 forming the channel (FIG. 3*a*). An elongated cutout 22 extending across the vertical section 18 is formed proximate the front end of the stationary channel. Preferably, cutout 22 is formed adjacent the front end of a stationary member and typically has a width of less than an inch.

As further illustrated in FIG. 3*a*, apertures 28 are formed in the lateral sections 20, 21 of the stationary member at opposite ends of cutout 22. These apertures are wider than the cutout 22 formed in the web section of the stationary member and together with cutout 22 form one continuous opening. All three cutouts are aligned laterally across the channel forming a continuous cutout.

Figure 3B:
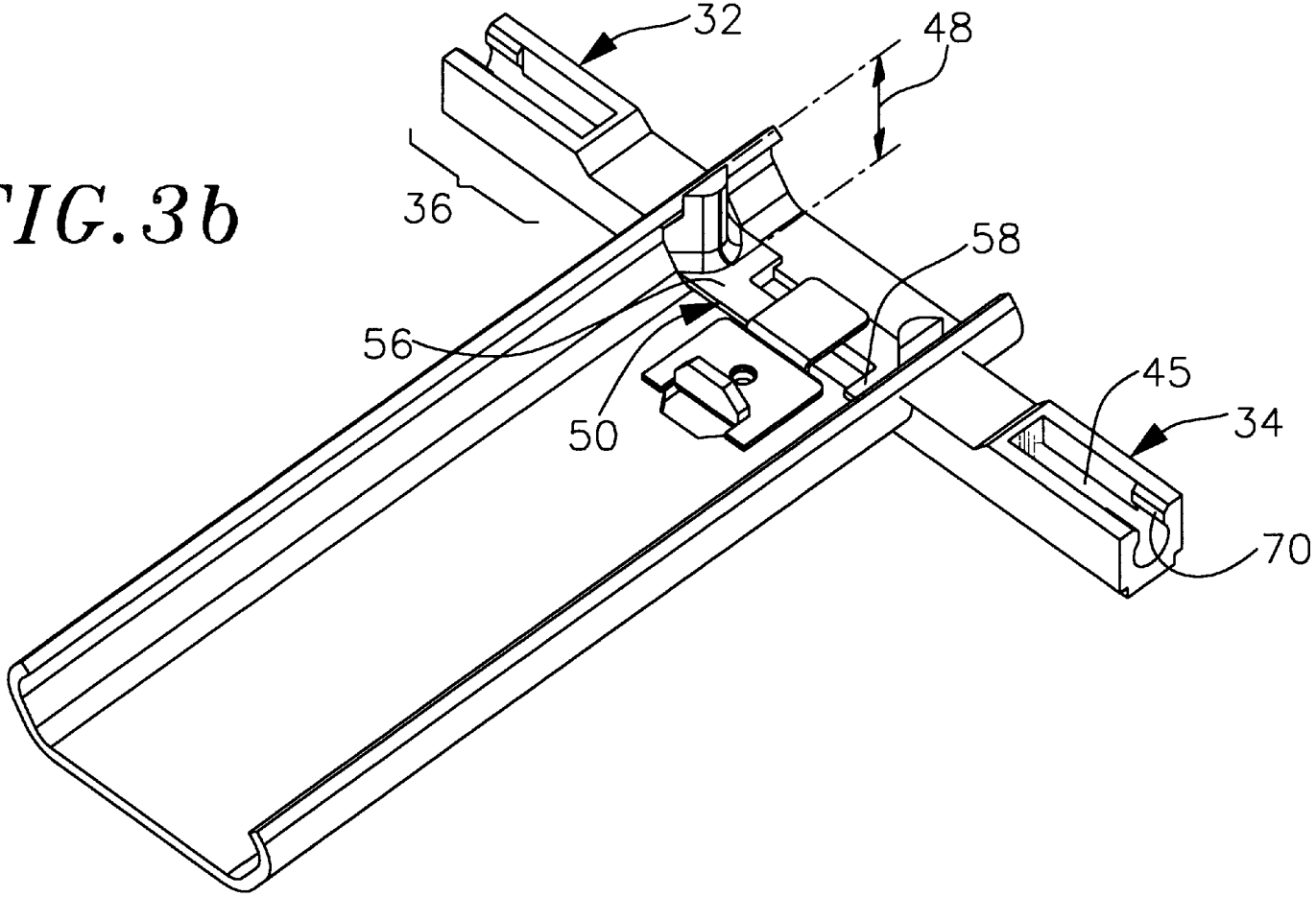
FIG. 3*b* is an isometric view of a slide stationary member with fitted upper and lower actuator followers.
Figure 3C:
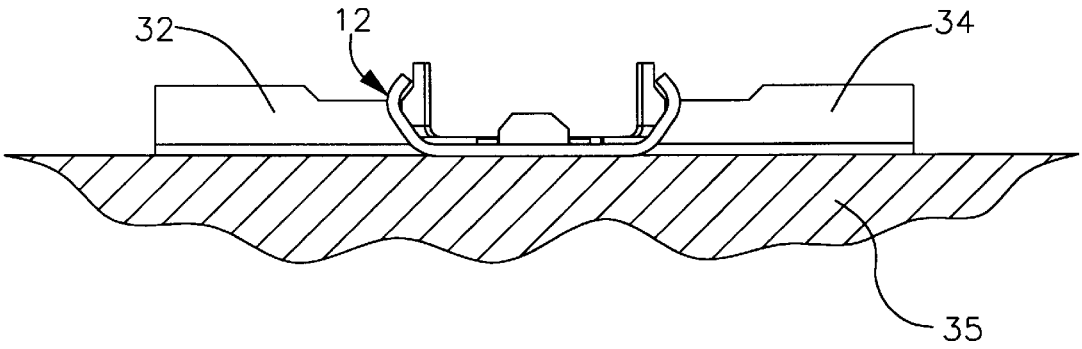
FIG. 3*c* is an end view of a stationary member with actuator followers mounted on a cabinet wall.

Opposed upper and lower actuator followers 32, 34 are slidably fitted within these cutouts (FIG. 2, 3*a*, 3*b*). The upper actuator follower 32 is slidably fitted through the cutout formed on the upper lateral section of the stationary member. Similarly, the lower actuator 34 follower is fitted through the cutout formed on the lower lateral section (FIGS. 1, 2, 3*b*). The actuator followers normally are fitted within the cutouts prior to attachment of the stationary member of the slide to cabinet wall 35 (FIG. 3*c*). When fitted within the cutouts, a portion of each actuator follower extends outside of the stationary member beyond the lateral sections. For descriptive purposes, the portion 36 of the actuator follower that always extends beyond the lateral section is referred herein as the "external portion" of the actuator follower (FIG. 1).

Figure 4C:
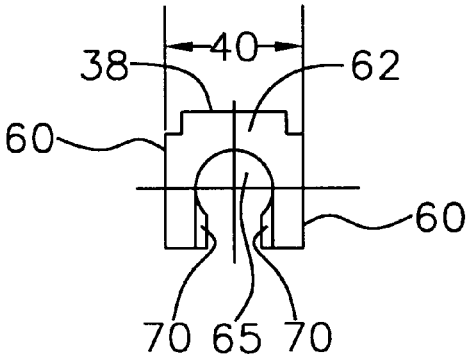
FIG. 4*c* is a top view of an actuator follower.
Figure 4A:
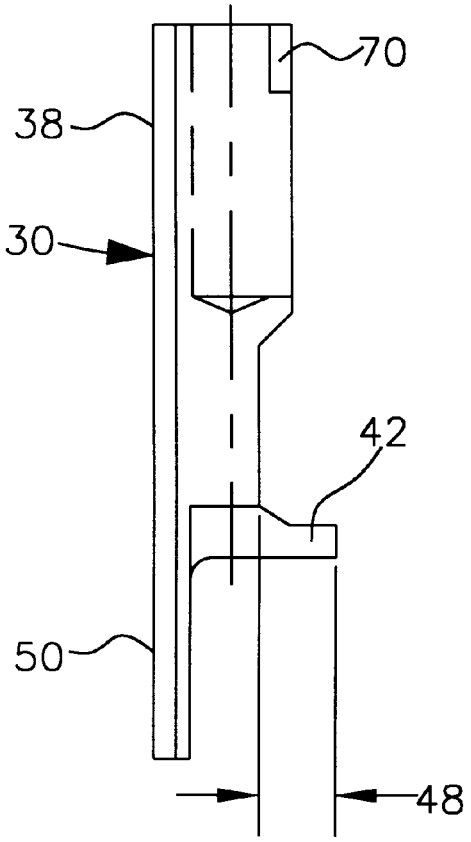
FIG. 4*a* is a side view of an actuator follower.

The rear surface 38 of the actuator follower is stepped down in width FIGS. 4*a* and 4*c*. This stepped-down portion allows the rear surface of the actuator to fit and slide within the vertical cutout on the vertical section of the stationary member. The wider portion 40 of the actuator follower is designed to fit and slide within the cutouts 28 formed in the lateral sections of the stationary member. The narrower portion of the actuator follower serves as a guide for guiding the stepped down back portion of the actuator follower and thereby, guiding the sliding motion of the actuator follower.

Figure 4B:
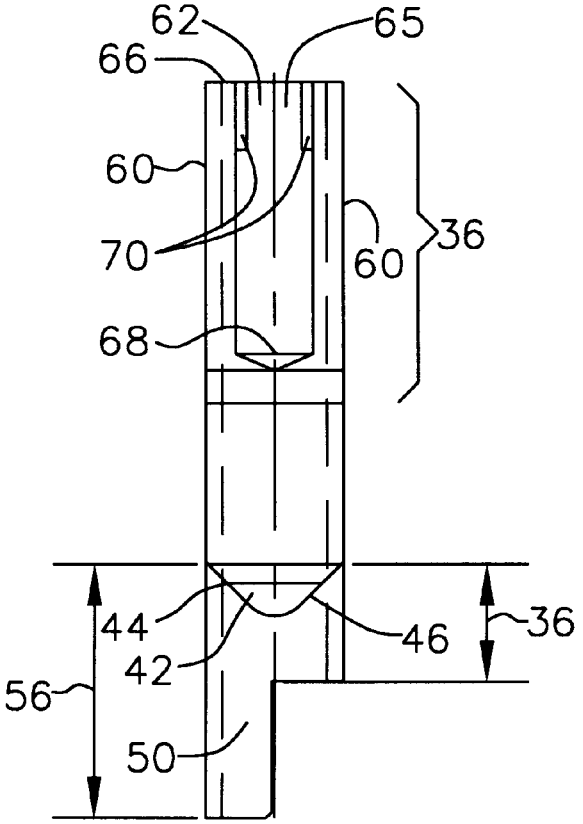
FIG. 4*b* is a front view of an actuator follower.

Each actuator follower has a laterally projecting member 42 which has a typically conical cross-sectional geometry with a rounded apex (FIGS. 4*a*, 4*b*). The inclined surfaces 44,46 of the conical projection are preferably at 45°. Once an actuator follower is slidably fitted within the stationary member, its conical projection is located between the two lateral sections 20,21 of the stationary member. Moreover, the conical projection has a length 48 such that it projects beyond the cutout on the lateral section of the stationary member. As a result, once the follower is inserted into the aperture, the conical projection prevents the actuator follower from sliding beyond a lateral section of the stationary member (FIGS. 3*b*, 3*c*).

A vertical projection 50 extends perpendicularly beyond the conical surface as part of the back side 38 of the actuator follower (FIGS. 4*a*, 4*b*). The vertical projections from the two opposing actuator followers are designed to abut against each other when one actuator follower slides toward the other (FIGS. 1 and 2). Therefore, as one actuator follower moves toward the other, it displaces the other actuator follower.

Figure 5A:
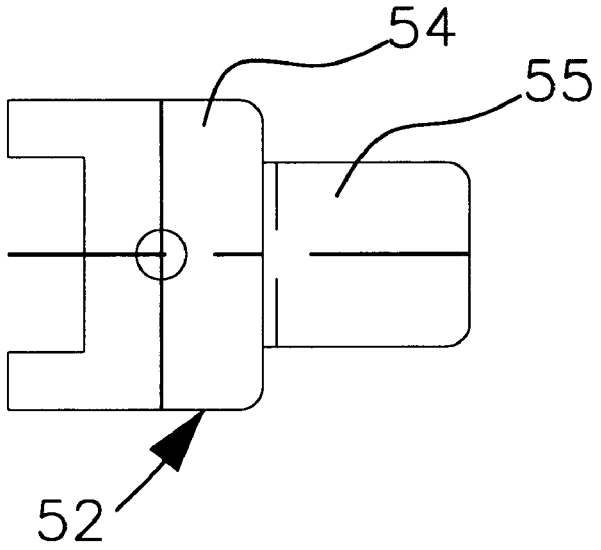
FIG. 5*a* is a top view of a retention clip.
Figure 5B:
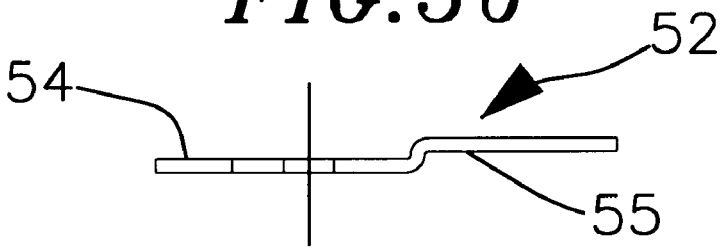
FIG. 5*b* is a side view of a retention clip.
Figure 6:
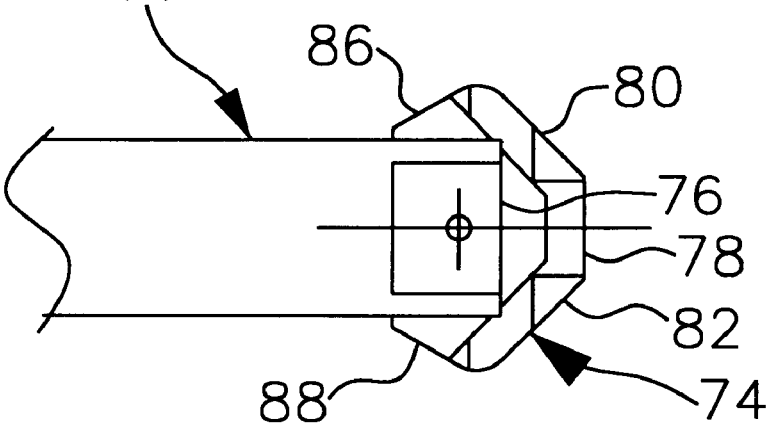
FIG. 6 depicts the actuator mated to the front end of the telescopic member.

An actuator follower retention clip 52 may be used to retain the actuator followers within the stationary member of the slide (FIGS. 5*a*, 5*b*). The retention clip is typically a metallic strip that is shaped to form two sections offset from each other in parallel. One section 54 of the clip is fixed or fastened to the stationary member such that the other offset section 55 defines a space through the vertical cutout 22 between itself and the cabinet surface upon which the stationary member is mounted. The projections of the actuator followers slide within that space (FIGS. 1, 2, 3*a*, 3*b*, 5*a*, 5*b*).

To ensure that an actuator follower is always retained by the retention clip, i.e., to ensure that a vertical projection of an actuator follower does not slide beyond the area covered by the retention clip, the projection 50 is stepped along its width. For half of its width the projection has a longer length 56 than it does for the other half of its width. The stepped projections of opposing actuator followers are complimentary to each other (FIGS. 1, 2).

The external portion 36 of the actuator follower has a depth which is greater than the length of the cutout 28 on the lateral sections of the stationary member. This prevents the external portion from sliding through the lateral sections. The external portion forms an internal vertical channel 65. The channel is formed by two sidewalls 60 connected by a lateral wall 62. The lateral wall 62 is part of the back surface of the actuator follower (FIGS. 4*b*, 4*c*). The channel's upper end 66 is open while its bottom end 68 is bounded by the lower portion of the actuator follower. A small lip 70 is formed on the inner surface of each sidewall. The lip spans only a portion of the inner surface of each sidewall, both longitudinally and laterally, beginning from the horizontal and lateral edges of the sidewall.

Rods 72 are used to interconnect the actuator followers of adjacent slides (FIGS. 1, 2). For example a rod connects the upper actuator follower 32 of one slide to the lower actuator follower 34 of the slide directly above it. The rods used may have any cross-sectional shape. For descriptive purposes however, reference is being made herein to cylindrical rods.

The rods are inserted into the channel opening of the external portions of the actuator followers. The rods are inserted by pushing them past the lips 70 on the inner surfaces of the sidewalls. The rods pass the lips and "snap" in place. The lips serve as retainers to maintain the rods within the channel opening. The rods can also be easily removed, if necessary, by pulling them ("snapping" them) out past the lips. When inserted into the vertical channel openings, it is preferred that the rods are able to freely slide within the channel openings.

An actuator 74 is attached to the front of the slide telescopic member. When attached, the actuator surrounds the front end 76 of the telescopic member 84 (FIG. 2). The actuator has flat face 78 parallel to the end of the telescopic member end. Two inclined surfaces 80,82 extend toward the telescopic member end from the upper and lower ends of the flat face. Preferably, the surfaces are symmetric about the telescopic member longitudinal axis 84. These surfaces are referred to herein as the front inclined surfaces. These surfaces continue past the vertical plane of the end of the telescopic member and then gradually bend by approximately 900 toward the upper and lower edges of the telescopic member forming another set of angled surfaces 86,88 (referred to herein as the "rear inclined surfaces") relative to the slide longitudinal axis. Although it is preferred that the front and rear inclined surfaces are inclined at 45°, they can be inclined at other angles.

The inclined surfaces of the conical projections of the actuator followers ride on the inclined surfaces of the actuator. Therefore, it is preferred that the inclination of the surfaces of the actuator match the inclination of the contacting surfaces on the conical projections.

When the actuator followers are in their fully extended position i.e., when their conical projections abut against the lateral sections of the stationary member, they do not interfere with the extension path of the telescopic member. When the first telescopic member is extended, the distance between the conical projections of the followers can be greater than the widest section of the actuator (FIG. 7) by a very small margin. When the distance between the conical projections is less than the widest section of the actuator, the projections will present a block to the extension path of the actuator and thereby the telescopic member. In one embodiment, each actuator follower is allowed to slide approximately ½ inch from its extended position.

Figure 3D:
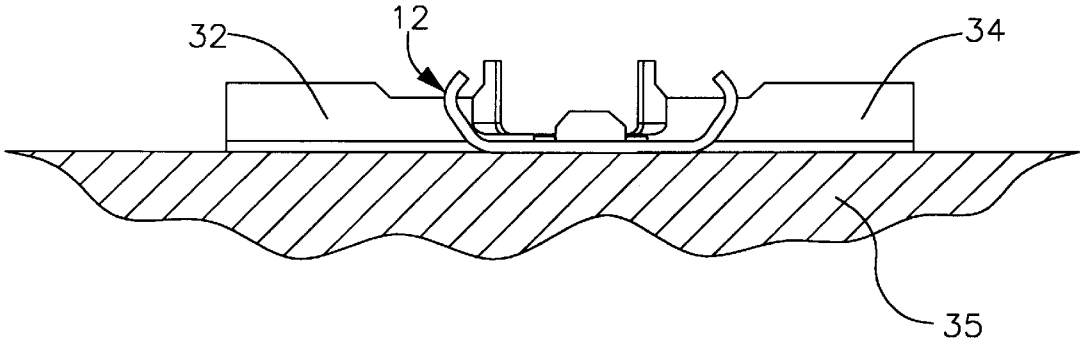
FIG. 3*d* is an end view of a stationary member with one actuator follower displacing the other.

When the telescopic inner member is in a closed position (FIG. 1), the conical projections 42 of the lower actuator follower rest under the influence of gravity, fully extended against the bottom lateral section 20 of the stationary member 12 of the slide, while the upper actuator follower, also due to gravity, is in its fully closed position with its conical projection blocking the extension path of the telescopic member 14 (FIGS. 1, 2). If all the telescopic members in a cabinet are closed and the telescopic member of one slide is extended from its closed position, the upper front inclined surface 80 of the actuator contacts the preferably matched tapered surface 42 of the conical projection of the upper actuator follower causing the actuator follower to be displaced upward (FIGS. 1, 2). Consequently, the actuator follower pushes on the rod 72 interconnecting it with the lower actuator follower of the slide directly above it and bringing such lower actuator follower's conical projection in the extension path of its telescopic member. Simultaneously, the vertical step-shaped projection 50 (FIGS. 3*d*, 4*b*) of the lower actuator abuts against the vertical step-shaped projection of its opposing upper actuator displacing the upper actuator. Similarly, all actuator followers of the slides located above the extended slide move the same way. Consequently, the conical projections of the lower actuator followers on all of the slides above the extended slide block and prevent the extension of their respective slide's telescopic members. Similarly, the extended slide blocks the upward movement of the upper actuator followers of the lower slides, i.e., the slides below it. Therefore, the conical projections of the upper actuators of the slides below the extended slide block and prevent the extension of those slides' telescopic members.

Since the rods can slide within the channel openings of the actuator followers and since the actuator followers travel from their extended to their closed position is relatively significant (e.g., ½ inch for the preferred embodiment), with blocking occurring within the first ⅛ inch of travel, it would be appreciated by one skilled in the art that the tolerances of the rod lengths do not have to be precise for the interlock assembly to properly function.

Figure 7:
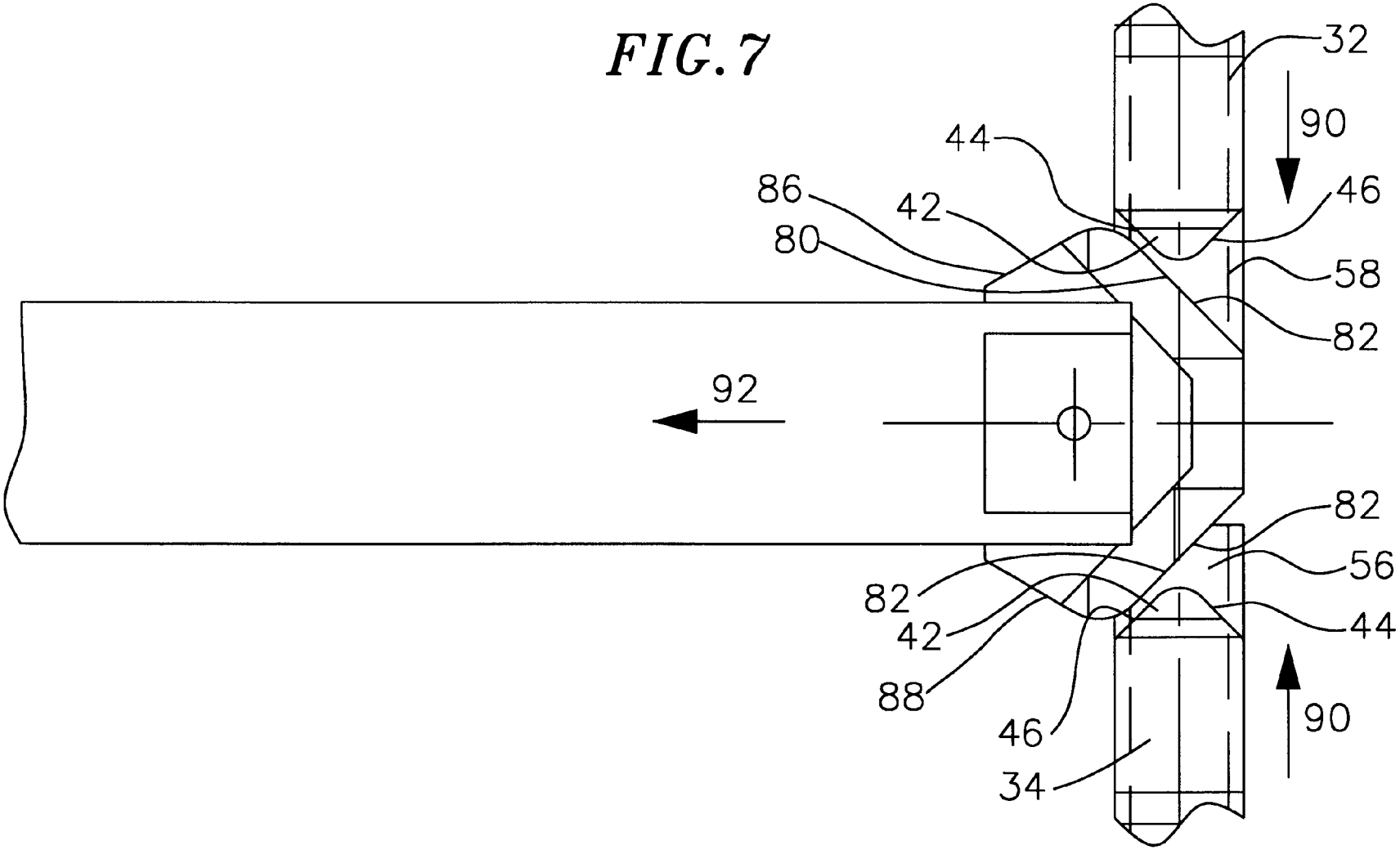
FIG. 7 depicts contact made by the actuator followers on the actuator so as to force the actuator and its telescopic member to a closed position.

If a drawer, and thereby a slide, is partially opened so that a front inclined surface 80,82 of the slide's actuator is in contact with any of the conical projections of the actuator followers, while another slide is being opened, the closing or compressing movement 90 of the actuator followers 32,34 will cause their surfaces 44,46 to bear on the front inclined surfaces 80,82 of the actuator generating a force along the axis of the telescopic member causing the actuator and telescopic member to move in a direction 92 backward to a closed position (FIG. 7). Moreover, as the telescopic member of the slide moves toward the closed position (FIG. 7)

after being extended, the rear inclined surfaces 86,88 of the actuator will contact the tapered surfaces 44, 46 of the conical projection and cause them to extend so as to allow the telescopic member to close (FIG. 2). To soften the impact of the actuator with the actuator follower and to quiet operation, the actuator and actuator followers are preferably made from a polymeric material.

This interlocking assembly can also easily be provided with a locking capability by interfacing with a separate locking system or mechanism. For example, a locking system 100 may comprise a member 102 which blocks the upward displacement of the actuator followers, thereby preventing any of the slide members from opening. This can be accomplished by using a lock member which can slide in front of the travel path of a rod connected to the upper actuator follower of the uppermost slide member.

Figure 8:
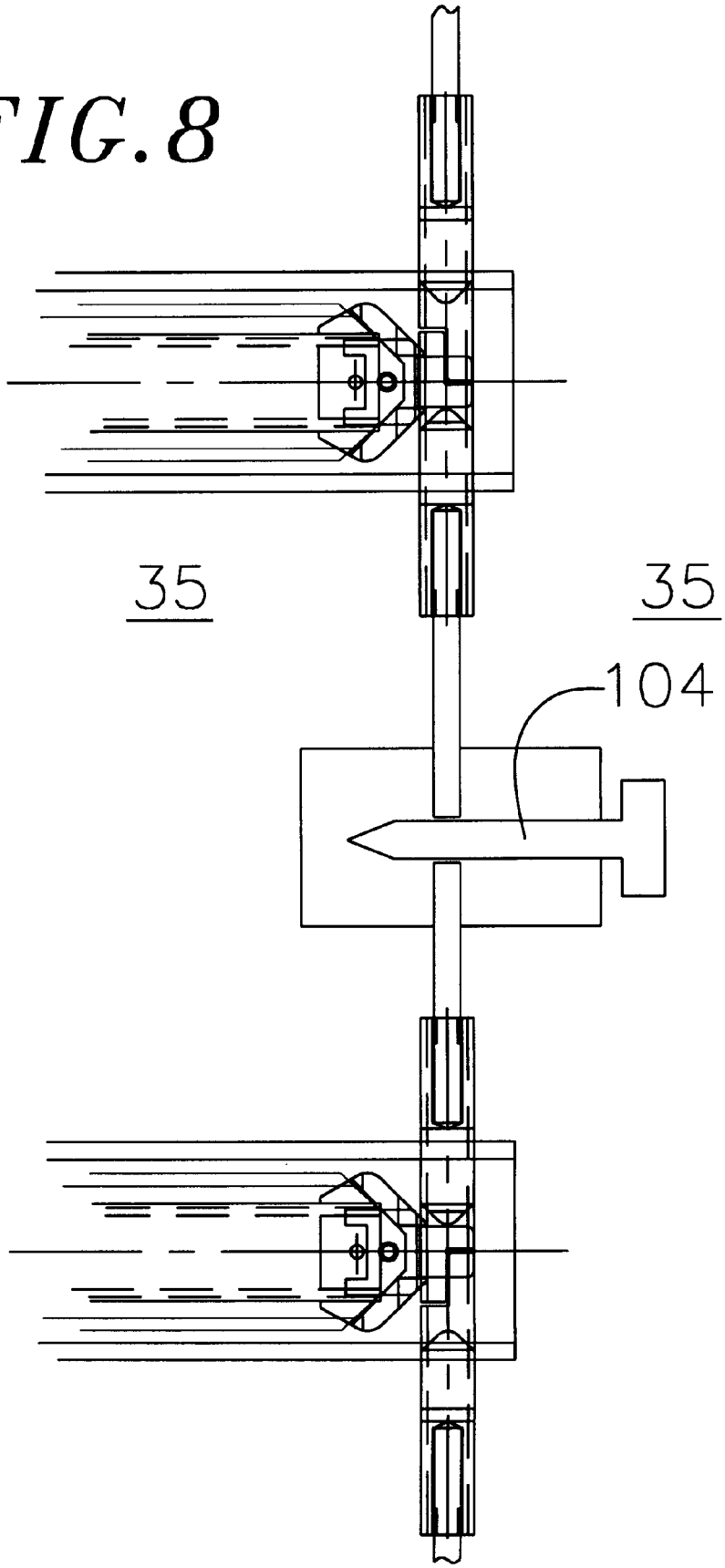
FIG. 8 depicts a lock member biasing an intermediate rod for the purpose of locking the slides.

As it would become obvious to one skilled in the art, the locking mechanism can be located at any location along the interlock assembly. For example, as shown in FIG. 8 a lock or biasing member 104 can be used to bias any of the rods such that all the lower actuator followers on the slides directly above the biasing member are displaced upward, while all the upper actuator followers of the slides directly below the biasing member 104 are prevented from being displaced upward. Consequently, all actuator followers will be in a position blocking the extension of their respective telescopic members.

It should also be apparent to one skilled in the art the interlock assembly of the present invention can operate without an upper actuator follower incorporated in the uppermost slide, and likewise, without a lower actuator follower incorporated into the bottommost slide.

The interlock assembly as described herein has several advantages. The interlock assembly of the present invention allows for modular construction. It can be used in cabinet having drawers of different heights. All that is required to accommodate the different height drawers is to use interconnect rods of appropriate length. All other required hardware remains the same. Another advantage is that the inventory costs associated with the interlock assembly of the present invention are reduced since only the length of the rods changes from assembly to assembly. Moreover, installation labor is reduced, since the assemblers need no longer build the interlock system by installing slides from the bottom of the cabinet upward as is required with most current interlock systems. The assemblers can install the rods in any order most convenient to them. In addition, since the locking mechanisms (actuator followers and interconnecting rods) maintain the actuating displacement while the drawer is open, there is virtually no chance that the system would malfunction and allow additional drawers to be fully opened, or inadvertently lock all drawers.

Although this invention has been described in certain specific embodiments, many additional modifications and variations will be apparent to those skilled in the art. It is therefore, to be understood that within the scope of the appended claims, this invention may be practiced otherwise than as specifically described. For example, when adjacent drawers are narrow and their respective slides are close together, the actuator followers may be fitted together or abutted so as not to require use of a connecting rod.

What is claimed is:

1. A drawer slide interlock assembly for preventing the extension of a drawer once another drawer has been opened, comprising:

first and second spaced apart slides, the second slide being located above and vertically displaced relative to the first slide, each slide comprising a stationary member for attachment to a unit housing, and a telescopic member for attachment to one of said drawers, the telescopic member being extendible from a front end of the stationary member;

a pair of upper and lower actuator followers slidably and perpendicularly fitted in each stationary member, the actuator followers being located in opposed relation to each other proximate the front end of the stationary member, wherein each actuator follower slides between a position blocking and a position not blocking the extension of one of the telescopic members; and a plurality of longitudinal rods, one of said rods having one end removably connected to the upper actuator follower of the first slide and another end removably connected to the lower actuator follower of the second slide, whereby extension of the telescopic member of the first slide moves the upper actuator follower of the first slide and said one rod upwardly moving the lower actuator follower of the second slide upwardly so as to block and prevent the extension of the telescopic member of the second slide.

2. An interlock assembly as recited in claim 1 wherein said one rod ends are slidably connected to the actuator followers.

3. An interlock assembly as recited in claim 1 further comprising an actuator connected to a front end of each telescopic member for making contact and displacing the actuator followers as the telescopic member is extended.

4. An interlock assembly as recited in claim 3 wherein the actuator of one slide comprises an upper inclined surface for making contact with the upper actuator follower of said one slide for lifting the upper actuator follower of said one slide as the telescopic member of said one slide is extended.

5. An interlock assembly as recited in claim 4 wherein the actuator upper inclined surface is inclined at an angle of approximately 45° relative to the telescopic member's longitudinal axis.

6. An interlock assembly as recited in claim 5 wherein a surface of the upper actuator follower making contact with the actuator upper inclined surface is inclined so as to be parallel to the actuator upper inclined surface.

7. An interlock assembly as recited in claim 4 wherein the actuator having the upper inclined surface further comprises a lower inclined surface for contacting the lower actuator follower of said one slide, wherein compression against said actuator upper and lower inclined surfaces caused by the simultaneous contact of the upper inclined surface by the upper actuator follower of said one slide and of the lower inclined surface by the lower actuator follower of said one slide forces the actuator and thereby the telescopic member of said one slide to retract toward a closed position.

8. An interlock assembly as recited in claim 7 wherein the actuator lower inclined surface is inclined at an angle of approximately 45° relative to the telescopic member's longitudinal axis.

9. An interlock assembly as recited in claim 7 wherein a surface of the lower actuator follower making contact with the actuator lower inclined surface is inclined so as to be parallel to the lower inclined surface.

10. An interlock assembly as recited in claim 1 wherein each upper and lower actuator follower of each slide further comprises a vertically oriented projection, wherein when the actuator followers move toward each other, the projections abut against each other.

11. An interlock assembly as recited in claim 10 further comprising a retention clip for each stationary member each retention clip fastened to each stationary member and extending over the vertically orienting projections of the actuator followers fitted in each stationary member.

12. An interlock assembly as recited in claim 10 further comprising a central locking means for preventing one of said actuator followers in each slide from moving to the position of not blocking the extension of the slides' telescopic members.

13. An interlock system assembly as recited in claim 12 wherein the locking means comprises a lock member located above the second slide, wherein the member can slide between a lock position and an unlock position, wherein when in the lock position, the lock member is positioned so as to prevent the second slide upper actuator follower from sliding to the position of not blocking the extension of the second slide telescopic member.

14. An interlock assembly as recited in claim 12 wherein the central locking means is positioned along a path of any of said rods and simulates the action of an open drawer by biasing at least one of the rods and displacing upper and lower actuator followers thereby blocking extension of telescopic members.

15. An interlock assembly as recited in claim 1 further comprising:

a third slide located above the second slide comprising a stationary member for attachment to the unit housing, and a telescopic member for attachment to one of said drawers, the telescopic member being extendible from a front end of the stationary member;

a pair of upper and lower actuator followers slidably and perpendicularly fitted in the third slide stationary member, the actuator followers in opposed relation to each other proximate the front end of the stationary member, wherein each actuator follower can slide between a position blocking and a position not blocking the extension of the third slide telescopic member; and another of said longitudinal rods having one end removably connected to the upper actuator follower of the second slide and another end removably connected to the lower actuator follower of the third slide, wherein extension of the telescopic member of one of the slides displaces the upper actuator follower of said one slide and the lower actuator follower of any slide located above the extended slide whereby said displaced lower actuator follower blocks the extension of its slide's telescopic member, and wherein the upper actuator follower of any slide below the extended slide is prevented from moving from a position of blocking to a position of not blocking the extension of the telescopic member of its slide.

16. A drawer slide interlock assembly for preventing the extension of a drawer once another drawer has been opened, comprising:

a first and a second slide, the second slide located above the first slide, each slide comprising a stationary member for attachment to a unit comprising said drawers and a telescopic member for attachment to one of said drawers, the telescopic member being extendible from a front end of the stationary member;

an actuator connected to a front end of each slide telescopic member;

a lower actuator follower for engaging the actuator connected to the front of the second slide telescopic member, the lower actuator follower located proximate the front end of the stationary member of the second slide, the lower actuator follower slidably and perpendicularly coupled to the stationary member of the second slide;

an upper actuator follower for engaging the actuator connected to the front of the first slide telescopic member, the upper actuator follower located proximate the front end of the stationary member of the first slide, the upper actuator follower slidably and perpendicularly coupled to the stationary member of the first slide; and a rod having one end removably connected to the upper actuator follower and its other end removably connected to the lower actuator follower, wherein extension of the first slide telescopic member moves the upper actuator follower upward which moves the rod upward which moves the lower actuator follower of the second slide upward so as to block and prevent the extension of the second slide telescopic member, and wherein extension of the second slide telescopic member prevents the first slide upper actuator follower from moving to a position not blocking the extension of the first slide telescopic member thereby preventing the extension of the first slide telescopic member.

17. An interlock assembly as recited in claim 16 wherein the actuator connected to the front of the first slide telescopic member comprises an upper inclined surface for making contact with the upper actuator follower and displacing the upper actuator follower as the telescopic slide of the first slide is extended.

18. An interlock assembly as recited in claim 16 wherein the actuator connected to the front of the second slide telescopic member comprises a lower inclined surface for contacting the lower actuator follower.

19. An interlock assembly as recited in claim 16 further comprising a locking means for preventing one of said actuator followers from moving to a position of not blocking the extension of the its' telescopic member.

20. An adjustable drawer slide interlock assembly for preventing the extension of one of a plurality of drawers once another drawer of said plurality of drawers has been opened, comprising:

at least one intermediate slide vertically arranged between an uppermost and a lowermost slide, each slide comprising a stationary member for attachment to a unit housing, and a telescopic member for attachment to one of said drawers, the telescopic member being extendible from a front end of the stationary member;

upper and lower actuator followers slidably fitted in opposing and displacing relationship proximate the front end of the stationary member of each intermediate slide for blocking and preventing the extension of the telescopic member of said each intermediate slide;

an upper actuator follower slidably fitted proximate the front end of the lowermost slide;

a lower actuator follower slidably fitted proximate the front end of the uppermost slide;

an actuator coupled proximate the front end of each telescopic member; and a rod for interconnecting each pair of upper and lower actuator followers fitted in subsequent slides, the rod having one end removably connected in a sliding relationship to the upper actuator follower of one slide and another end removably connected in a sliding relationship to the lower actuator follower of the subsequent slide, wherein by varying the length of the rods and the spacing between slides, the assembly can accommodate drawers of different heights.

21. An interlock assembly as recited in claim 20 further comprising an upper actuator follower slidably fitted in opposing and displacing relationship to the lower actuator follower of the uppermost slide proximate the front end of the stationary member of the upper most slide.

22. An interlock system assembly as recited in claim 21 comprising a lock member located above the uppermost slide, wherein the lock member can slide between a lock position and an unlock position, wherein when in the lock position, the lock member is positioned so as to prevent the uppermost slide upper actuator follower from sliding to a position of not blocking the extension of the uppermost slide telescopic member.

23. An interlock assembly as recited in claim 20 further comprising a lower actuator follower slidably fitted in opposing and displacing relationship to the upper actuator follower of the lowermost slide proximate the front end of the stationary member of the lowermost slide.

24. An interlock system assembly as recited in claim 23 comprising a lock member located below the lowermost slide, wherein the lock member can slide between a lock position and an unlock position, wherein when in the lock position, the lock member is positioned so as to prevent the lowermost slide upper actuator follower from sliding to a position of not blocking the extension of the lowermost slide telescopic member.

25. An interlock assembly as recited in claim 20 wherein one of said rods is a two-section rod comprising an upper section separate from a lower section, wherein an end of the upper section is removably connected to the lower actuator follower of one slide and wherein an end of the lower section is removably connected to the upper actuator follower of the slide immediately below said one slide, wherein the interlock assembly further comprises a lock member positioned along the path of the two-section rod wherein the lock member is slidable to a position biasing the two-section rod displacing the rod upper section from the rod lower section and displacing the upper and lower actuator followers connected to said two-section rod in position blocking the extension of the corresponding telescopic members.

* * * * *

UNITED STATES PATENT AND TRADEMARK OFFICE

CERTIFICATE OF CORRECTION

PATENT NO. : 5,988,778
DATED : November 23, 1999
INVENTOR(S) : Arthur E. Lammens It is certified that error appears in the above-identified patent and that said Letters Patent is hereby corrected as shown below:

Column 10,
Line 35, after "extension of" delete "the".

Signed and Sealed this

Eighteenth Day of September, 2001

*Attest:*

Nicholas P. Godici

*Attesting Officer*

NICHOLAS P. GODICI
*Acting Director of the United States Patent and Trademark Office*